US005213035A

United States Patent [19]

Becker

[11] Patent Number: 5,213,035

[45] Date of Patent: May 25, 1993

[54] DEVICE FOR CHANGING-OVER A GRIPPER CONTROL ON A GRIPPER CYLINDER OF A TURNING DEVICE IN A SHEET-FED ROTARY PRINTING MACHINE FOR FIRST-FORM AND PERFECTOR PRINTING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 948,238

[22] Filed: Sep. 21, 1992

[30] Foreign Application Priority Data

Sep. 20, 1991 [DE] Fed. Rep. of Germany ..... 4131273

[51] Int. Cl.[5] ..... B41F 21/10; B41F 5/02; B41F 3/40

[52] U.S. Cl. ..... 101/230; 101/411

[58] Field of Search ..... 101/230, 231, 407–412, 101/246, 247, 248; 74/439, 444, 445, 440; 192/70.11, 70.23; 271/82, 184, 902, 225

[56] References Cited

U.S. PATENT DOCUMENTS

| | | | |
|---|---|---|---|
| 4,831,929 | 5/1989 | Saito | 101/230 |
| 5,031,531 | 7/1991 | Becker | 101/230 |
| 5,033,379 | 7/1991 | Becker | 101/230 |
| 5,048,362 | 9/1991 | Becker | 101/248 |
| 5,069,126 | 12/1991 | Becker | 101/230 |
| 5,076,164 | 12/1991 | Becker | 101/230 |
| 5,105,737 | 4/1992 | Becker | 101/230 |
| 5,136,946 | 8/1992 | Becker | 101/230 |

FOREIGN PATENT DOCUMENTS

| | | |
|---|---|---|
| 3814831 | 10/1989 | Fed. Rep. of Germany . |
| 3911609 | 10/1990 | Fed. Rep. of Germany . |
| 4004352 | 6/1991 | Fed. Rep. of Germany . |
| 63-53037 | 3/1988 | Japan . |

*Primary Examiner*—J. Reed Fisher

*Attorney, Agent, or Firm*—Herbert L. Lerner; Laurence A. Greenberg

[57] ABSTRACT

A device for changing-over a gripper control on a gripper cylinder of a turning device in a sheet-fed rotary printing machine for first-form and perfector printing, including an adjusting gear and a fixed gear disposed coaxially with one another, the adjusting gear being adjustably movable so as to vary the angular position thereof relative to that of the fixed gear, and a clamping device for clamping the adjusting gear and the fixed gear frictionally together, comprising a control shaft axially displaceable in the gripper cylinder, the control shaft being rotatable and being coupled, via a first intermediate converting device, with the adjusting gear so that an adjustable movement of the adjusting gear is converted thereby into a rotary movement of the control shaft, a spring device for applying a reaction force to the control shaft in a clamping direction of the adjusting gear, an adjusting bridge carried by the gripper cylinder so as to be displaceable in axial direction thereof, an angle lever disposed in the gripper cylinder so as to be swivelable therein about an axis transverse to the axis of the control shaft for transmitting radial forces to the adjusting bridge, the angle lever having an arm formed with a borehole, the control shaft extending through the borehole and being formed with an abutment shoulder, the shoulder, in a condition wherein the control shaft is loaded with a clamping force, being engageable with an opposing surface on the angle lever for acting thereon, and a second intermediate converting device for converting a rotary movement of the control shaft into an axial displacement of the adjusting bridge, the second intermediate converting device including an intermediate member, the control shaft having an end thereof directed towards a middle region of the printing machine and engaging in the intermediate member in a manner that the control shaft is fixed against rotation relative to the intermediate member yet axially displaceable relative thereto.

13 Claims, 5 Drawing Sheets

DEVICE FOR CHANGING-OVER A GRIPPER CONTROL ON A GRIPPER CYLINDER OF A TURNING DEVICE IN A SHEET-FED ROTARY PRINTING MACHINE FOR FIRST-FORM AND PERFECTOR PRINTING

The invention relates to a device for changing-over a gripper control on a gripper cylinder of a turning device in a sheet-fed rotary printing machine for first-form and perfector printing and, more particularly, to such a device which includes an adjusting gear and a fixed gear disposed coaxially with one another, the adjusting gear being adjustably movable so as to vary the angular position thereof relative to that of the fixed gear, and a clamping device for clamping the adjusting gear and the fixed gear frictionally together.

A device of this general type has become known heretofore from applicant's U.S. Pat. No. 5,031,531, for example. In this heretofore known device, a crownlike adjusting gear is rotatably arranged on a collar projection of a fixed gear on a gripper cylinder. A clamping device is formed of a pressure plate anchored to the fixed gear, of several radially directed pressure levers having respective outer ends braced on one side thereof against the adjusting gear and, in the vicinity of these ends and on the opposite side from the adjusting gear, against the pressure plate, and of a pretensioned spring, so that a reaction force thereof generates the clamping forces. This spring is fully restrained between a disc or washer and a collar or radial flange formed on a connecting rod which extends axially through the spring, so that the reaction forces of the pretensioned spring become ineffective by displacing the disc or washer on the connecting rod so as to release the clamping action, and become effective for producing the clamping action. An actuating member screwable on the connecting rod serves for effecting the displacement of the disc or washer while it simultaneously actuates a safety element in the electrical circuit of the printing machine, so that the circuit of the machine is interrupted, before the clamping action can be released, and must again be closed if the clamping action is to be reinstituted. When the connecting rod is axially displaced as a result of the reaction forces of the spring, it actuates, with an end thereof directed towards a middle region of the printing machine, one arm of an angle lever mounted in a recess formed in the cylinder so as to be pivotable about an axis extending transversely to the axis of the connecting rod, the other arm of the angle lever engaging under a clamp strip which transmits the tension forces acting radially t the axis of the gripper cylinder to an adjusting member or bridge which, due to its displacement parallel to the axis of the gripper cylinder, causes the change-over of the gripper control. Consequently, the reaction forces of the spring for clamping the crownlike adjusting gear and the fixed gear together also act as clamping forces between the angle and the adjusting member for changing over the gripper control, in this case, however, in radial direction so that it is monitored by the same safety elements.

To perform the change-over by a linear displacement of the adjusting member or bridge parallel to the axis of the gripper cylinder, a control shaft is rotatably mounted parallel to the connecting rod in a further axially parallel bore formed in the gripper cylinder. The control shaft has an end directed towards a middle region of the printing machine and extending beyond the end of the connecting rod, as well as beyond a recess wherein the angle lever is received, terminating in a further recess formed in the gripper cylinder, the end of the control shaft being coupled torsion-free, via inter-wheel gearing comprising a bevel-gear pair, with an eccentric mounted in a bore formed in the gripper cylinder and extending diametrically thereto, the eccentric, in turn, engaging in a coulisse formed in the adjusting member or bridge, so that a rotary movement of the control shaft is changed-over to a linear displacement of the adjusting member or bridge. To effect the change-over, manual actuation with a socket wrench is afforded, the socket wrench being applicable to a hexagon head formed on the control shaft and extending into a recess formed in the pressure plate, at an outwardly extending end of the control shaft on the drive side of the machine.

A simplified drive arrangement for the adjusting movement of a control shaft centrally mounted in a gripper cylinder has become known heretofore from Japanese Patent Sho 63-53037, however, a centrally operative clamping device is omitted therefrom. The crownlike adjusting gear and the fixed gear, in this known construction, are frictionally clamped to one another by several screws or bolts.

It has become known heretofore also from German Published Non-Prosecuted Application (DE-OS) 39 11 609, corresponding to U.S. Pat. No. 5,076,164 subsequently issued on Dec. 31, 1991 to applicant, to provide , for the adjusting movement, a coupling of the control shaft with the crownlike adjusting gear by toothed intermediate elements, so that the change-over of the gripper control is effected via the adjusting member or bridge, the control shaft and the toothed intermediate elements automatically occurs with the adjustment of the crownlike adjusting gear relative to the fixed gear for changing-over the printing machine from single side to first-form and perfector printing and the reverse. Further known from this patent is the construction of the toothed intermediate elements or a multilinkage lever transmission for coupling the crownlike adjusting gear with the control shaft so that the torques or rotary forces are transmitted only in an angular range which corresponds to the change-over of the adjusting member or bridge, so that the matching of the format is possible by a adjustment of the domelike adjusting gear relative to the fixed gear in a considerably greater angular range.

From German Patent 40 04 352 corresponding to U.S. Pat. No. 5,136,946 subsequently issued on Aug. 11, 1992 to applicant, a device has become known heretofore for transmitting clamping forces directed radially to the axis of the gripper cylinder for frictionally connecting the adjusting bridge on the gripper cylinder to several clamping locations disposed mutually adjacent in axial direction of the gripper cylinder. In addition thereto, bearing reaction forces of the angular lever, against an arm of which the control shaft presses, are transmitted by a slider and a swinging pressure or oscillating member to at least one further clamp strap, so that also the latter is subjected to a loading during the clamping, due to the reaction forces of the spring producing the clamping, and the adjusting bridge is clamped radially against the gripper cylinder.

It is accordingly an object of the invention to provide a device for changing-over a gripper control on a gripper cylinder of a turning device in a sheet-fed rotary printing machine for first-form and perfector printing, which is of simplified and space-saving construction and has a reduced volume of recesses which otherwise weaken the strength of the gripper cylinder as in previously known devices of this general type.

With the foregoing and other objects in view, there is provided, in accordance with the invention, a device for changing-over a gripper control on a gripper cylinder of a turning device in a sheet-fed rotary printing machine for first-form and perfector printing, including an adjusting gear and a fixed gear disposed coaxially with one another, the adjusting gear being adjustably movable so as to vary the angular position thereof relative to that of the fixed gear, and a clamping device for clamping the adjusting gear and the fixed gear frictionally together, comprising a control shaft axially displaceable in the gripper cylinder, the control shaft being rotatable and being coupled, via first intermediate converting means, with the adjusting gear so that an adjustable movement of the adjusting gear is converted thereby into a rotary movement of the control shaft, spring means for applying a reaction force to the control shaft in a clamping direction of the adjusting gear, an adjusting bridge carried by the gripper cylinder so as to be displaceable in axial direction thereof, an angle lever disposed in the gripper cylinder so as to be swivelable therein about an axis transverse to the axis of the control shaft for transmitting radial forces to the adjusting bridge, the angle lever having an arm formed with a borehole, the control shaft extending through the borehole and being formed with an abutment shoulder, the shoulder, in a condition wherein the control shaft is loaded with a clamping force, being engageable with an opposing surface on the angle lever for acting thereon, and second intermediate converting means for converting a rotary movement of the control shaft into an axial displacement of the adjusting bridge, the second intermediate converting means including an intermediate member, the control shaft having an end thereof directed towards a middle region of the printing machine and engaging in the intermediate member in a manner that the control shaft is fixed against rotation relative to the intermediate member yet axially displaceable relative thereto.

An outstanding feature of the invention is that the gripper cylinder the journal thereof on the drive side is formed with only one central borehole of relatively small cross section extending in axial direction of the gripper cylinder for receiving a control shaft therein which is effective both for the clamping as a connecting or pressure rod, as well as for the change-over. All of the heretofore-known advantages derived from prior-art constructions remain undiminished in the device according to the invention. The single shaft permits the clamping of the adjusting gear against the fixed gear under a predeterminable spring reaction force maintainable for each change-over, the transmission of this reaction force to the location of the adjusting bridge which provide a clamping connection with the gripper cylinder and, moreover, the automatic change-over of the gripper control during the angular adjustment between the crownlike adjusting gear and the fixed gear.

The advantage is also maintained that the reaction force of the spring for the clamping effect can also be transmitted selectively to several clamping locations of the adjacent bridge.

In accordance with another feature of the invention, the intermediate member is rotatably mounted in the gripper cylinder.

In accordance with a further feature of the invention, there is provided a bearing disposed in the gripper cylinder, the intermediate member having a journal received in the bearing for supporting the intermediate member, the journal being formed with a bore wherein the end of the control shaft is received.

In accordance with an additional feature of the invention, the control shaft is coaxial with the gripper cylinder, and wherein the first intermediate converting means include a toothed indexing wheel mounted on the control shaft outside and coaxially with the gripper cylinder, and an intermediate gear meshing with the indexing wheel and with the adjusting gear.

In accordance with an added feature of the invention, there are provided second intermediate converting means comprising an axial cam supported in a bearing in the gripper cylinder and formed with a pitch corresponding to a control path of the adjusting bridge, and cam following means connected to the adjusting bridge and engaging in the axial cam.

In accordance with yet another feature of the invention, the cam following means include a pin secured on the adjusting bridge.

With respect to the last two features mentioned, it is noted particularly that the axial cam of the invention, proposed for changing-over the rotary movement of the control shaft, during the change-over operation, into a linear movement for displacing the adjusting bridge is especially simple and rugged. It permits the axial control path, in a relatively simple manner, to be limited independently of the size of the angular adjustment of the adjusting gear relative to the fixed gear.

In accordance with again another feature of the invention, axial the cam extends over an angular range corresponding to a conversion angle for displacement of the adjusting bridge.

In accordance with again a further feature of the invention, the cam following means also include a roller mounted so as to be freely rotatable on the pin, the roller being received in the axial cam so as to follow the pitch thereof.

In accordance with again an added feature of the invention, the second intermediate converting means include an eccentric rotatable about an axis extending transversely to the axis of the control shaft, miter gearing connecting the eccentric to the control shaft for transmitting a drive thereto, and a coulisse formed on the control shaft, the eccentric engaging in the coulisse.

In accordance with again an additional feature of the invention, the coulisse has a construction wherein the eccentric, during rotation thereof, is axially displaceable within an angular range corresponding to a conversion angle for the adjusting bridge and, beyond the conversion angle, is displaceable in a free space.

In accordance with yet a further feature of the invention, the coulisse is formed of two straight control surfaces mutual enclosing a substantially right angle and disposed tangentially to an imaginary circle defining an outer locus of an apex of the eccentric during rotation thereof about the axis thereof, the coulisse defined by the control surfaces.

In accordance with yet an added feature of the invention, there is provided a gripper shaft carried by the gripper cylinder and having a stopping cam secured thereto, a radial cam secured to the control shaft, and a roller lever engaging and controllable by the radial cam for blocking the stopping cam.

In accordance with a concomitant feature of the invention, there is provided a gripper shaft carried by the gripper cylinder and having a stopping cam secured thereto, a rotatably mounted registering bar disposed adjacent the stopping cam, and a drive pinion secured to the adjusting shaft adjacent the rotatably mounted registering bar for driving the registering bar into a position wherein it blocks the stopping cam.

Other features which are considered as characteristic for the invention are set forth in the appended claims.

Although the invention is illustrated and described herein as embodied in a device for changing-over a gripper control on a gripper cylinder of a turning device in a sheet-fed rotary printing machine for first-form and perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
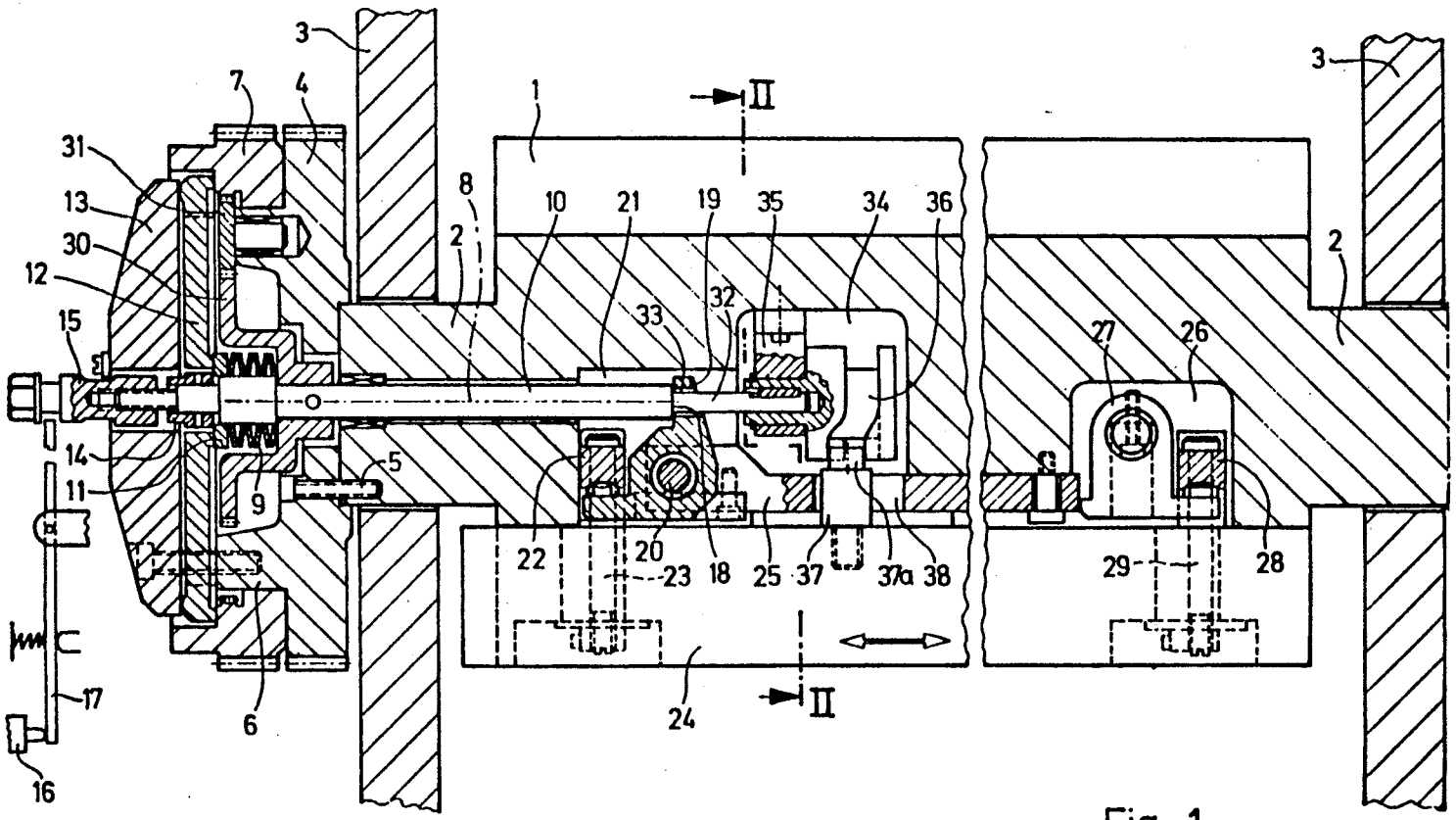
FIG. 1 is a longitudinal sectional view in an axial plane of an end of a turning cylinder on the drive side thereof incorporating the device according to the invention.

Referring now to the drawings and, first, particularly to FIG. 1 thereof, there is shown therein a gripper cylinder 1 of a turning device of a sheet-fed rotary printing machine for first-form and perfector printing which is supported at opposite sides thereof by journals 2 of reduced diameter in side parts 3 of the frame of the printing machine. Outside the side part 3 at the left-hand side of FIG. 1, a fixed gear 4 is securely fastened by bolts to an end face of the journal 2 located at the left-hand side of FIG. 1. The gear 4 is formed with a collar projection 6 disposed concentrically thereto, and a crownlike adjusting gear 7 is adjustably arranged on the collar projection 6 with respect to an axis 8 of the gripper cylinder 1. A frictional clamping connection is effected between the adjusting gear 7 and the fixed gear 4 by a reaction force of a spring 9 which is held under loading between a radial projection on a control shaft 10 extending axially through the spring 9 with radial play, and a movable washer or disc 11 which axially slides o the control shaft 10. Inner ends of several radially directed pressure levers 12 are braced against the outside of the washer 11, the outer ends of the pressure levers 12 being braced on one side thereof against the crownlike adjusting gear 7 and, on the other side thereof, which is formed with spherical or beadlike uses, against a pressure plate 13, so that the outer or free ends of the pressure levers 12, under the effect of the spring reaction force against the inner ends thereof, press the crownlike adjusting gear 7 with a friction-locking effect firmly against the fixed gear 4. To release the clamping effect, a thrust ring or collar 14 is provided which cooperates with a threaded sleeve 15 which is screwable onto a threaded pin formed at a free end of the control shaft 10. The threaded sleeve 15, in turn, cooperates with a switch 16 connected in the otherwise non-illustrated drive circuit of the printing machine, so that the threaded sleeve 15 can act upon the thrust ring 14 only if the switch 16, actuated by a rocker or double lever 17, has interrupted the drive circuit of the printing machine. On the other hand, the drive circuit of the printing machine may be closed by the switch 16 only if the spring 9 acts with full reaction force upon the clamping elements. By screwing the threaded sleeve 15 on the threaded pin at the end of the control shaft 10, the switch 16 is initially actuated before the threaded sleeve 15 acts upon the thrust ring 14, and the latter presses the washer 11, under additional pretensioning by the spring 9, in a direction against or towards the projecting shoulder formed on the control shaft 10, so that the pressure lever 12 is stress-relieved, and the clamping effect between the crownlike adjusting gear 7 and the fixed gear 4 is released. Screwing the threaded sleeve 15 in the opposite direction results, initially, in the washer 11 being pressed against the inner ends of the pressure levers 12, under the action of the spring 9 and, only after the reaction force of the spring 9 is fully effective against the inner ends of the pressure levers 12, an intermediate space is formed between the thrust ring 14 and the threaded sleeve 15, before the switch 16 for the machine drive circuit is freed or opened.

The control shaft 10 is axially displaceable within limits in the gripper cylinder 1, and is formed with an annular shoulder 18 with which it presses against an arm of an angle lever 19, which is mounted in a recess 21 formed in the gripper cylinder 1, and which is pivotable about a shaft 20 extending transversely to the axis 8, the angle lever 19 having another arm with which it engages under a clamping strap 22 which is connected by tension bolts 23 with an adjusting bridge 24, which is disposed so as to be movable linearly and substantially parallel to the axis 8, for effecting a gripper change-over. In the embodiment of the invention illustrated in FIG. 11, the angle lever 19 is mounted in a slider 25, which extends through to the other end of the gripper cylinder 1 and acts thereat against a swinging or oscillating member 27 which is mounted in a recess 26 and which, in turn, likewise engages the underside of a clamping strap 28 which is connected by tension bolts 29 to the adjusting bridge 24.

Due to these structural members, the reaction forces of the spring 9 are effective simultaneously as clamping forces for the adjusting bridge 24 which are effective radially in a direction towards the axis 8, so that a frictional clamping connection takes place between the adjusting bridge 24 and the gripper cylinder 1.

For automatically performing the change-over movement during the format adjustment, an indexing or stepping wheel 30 is fastened on the control shaft 10, on the drive side of the machine, outside the side part 3. The indexing wheel 30 has external teeth with which the teeth of an intermediate gearwheel 31 mesh in addition to meshing with internal teeth of the crownlike adjusting gear 7, so that an angular adjustment of the adjusting gear 7 with respect to the fixed gear 4 causes a turning movement of the control shaft 10. The end of the control shaft 10 directed towards the middle of the printing machine, i.e., the end thereof directed towards the right-hand side of FIG. 1, has a reduced-diameter section or extension 32 at the shoulder of the control shaft 10, the extension 32 passing through a borehole 33 formed in the on arm of the angle lever 19. The extension or prolongation 32, after passing through the borehole 33, terminates in a recess 34 formed in the gripper cylinder 1. The free end of the extension 32 engages in a journal of an axial cam 36, fixed against relative rotation therewith yet axially displaceable with respect thereto. The free end of extension 32 is thus rotatable together with the cam journal in a bearing 35 within the gripper cylinder 1, wherein the cam journal is supported, so that axial movements of the control shaft 10 with respect to the axial cam 36 permit the clamping. A pin 37 of the adjusting bridge 24 engages radially in the axial cam 36, so that rotation of the axial cam 36 results in linear displacement of the adjusting bridge 24. A roller 37*a* is advantageously, rotatably mounted on the pin 37 so as to reduce frictional resistances. The cam 36 has an axial slope or gradient which extends only over a change-over angle corresponding to the axial change-over movement for the gripper control, so that, during the angular adjustment of the crownlike adjusting gear 7 with respect to the fixed gear 4, an axial component of the movement is transmitted to the adjusting bridge 24 only within the range of this change-over angle. In the embodiment illustrated in FIG. 1, the pin 37 passes through a slot 38 formed in the slider 25 in order to prevent any hindrance or obstruction of the linear movement thereof during clamping release of the clamping.

Figure 2:
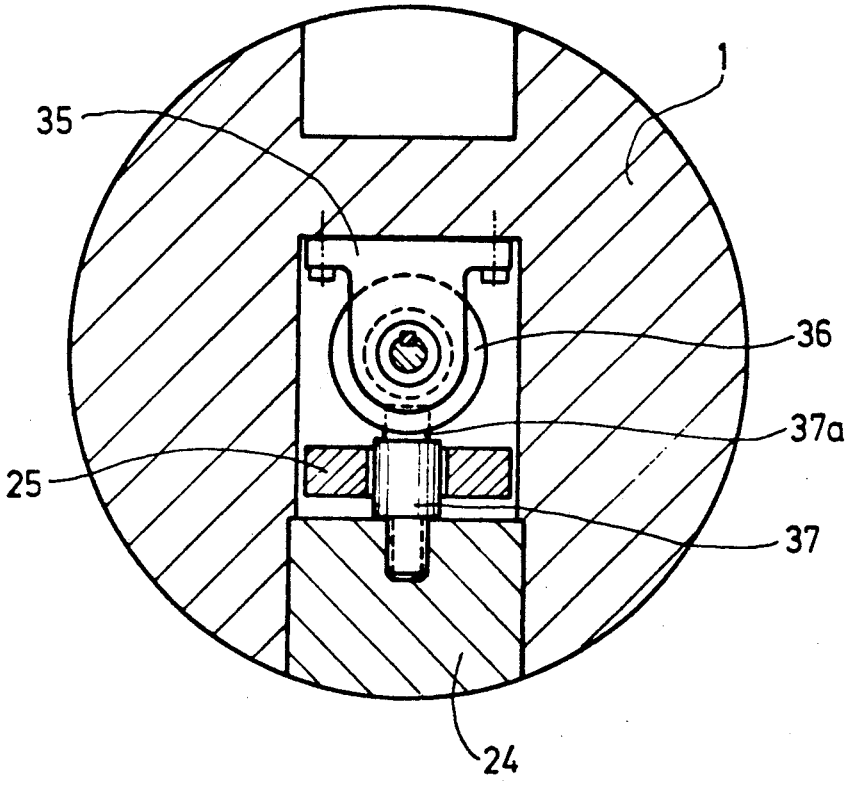
FIG. 2 is a cross-sectional view of FIG. 1 taken along the line II—II in the direction of the arrows.
Figure 3:
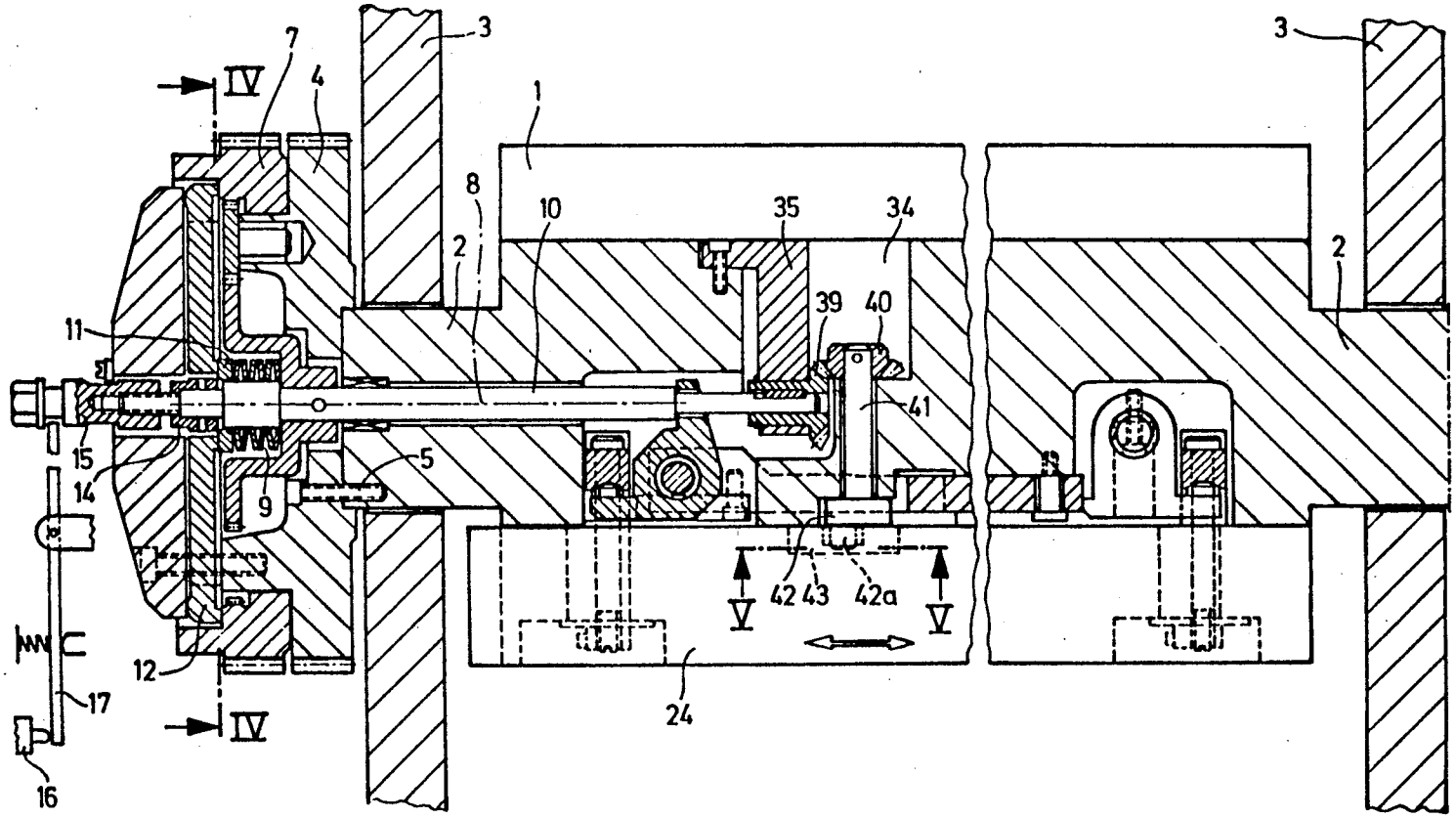
FIG. 3 is a view like that of FIG. 1 of another embodiment of the device according to the invention having transmission members of different construction from that of FIG. 1.
Figure 4:
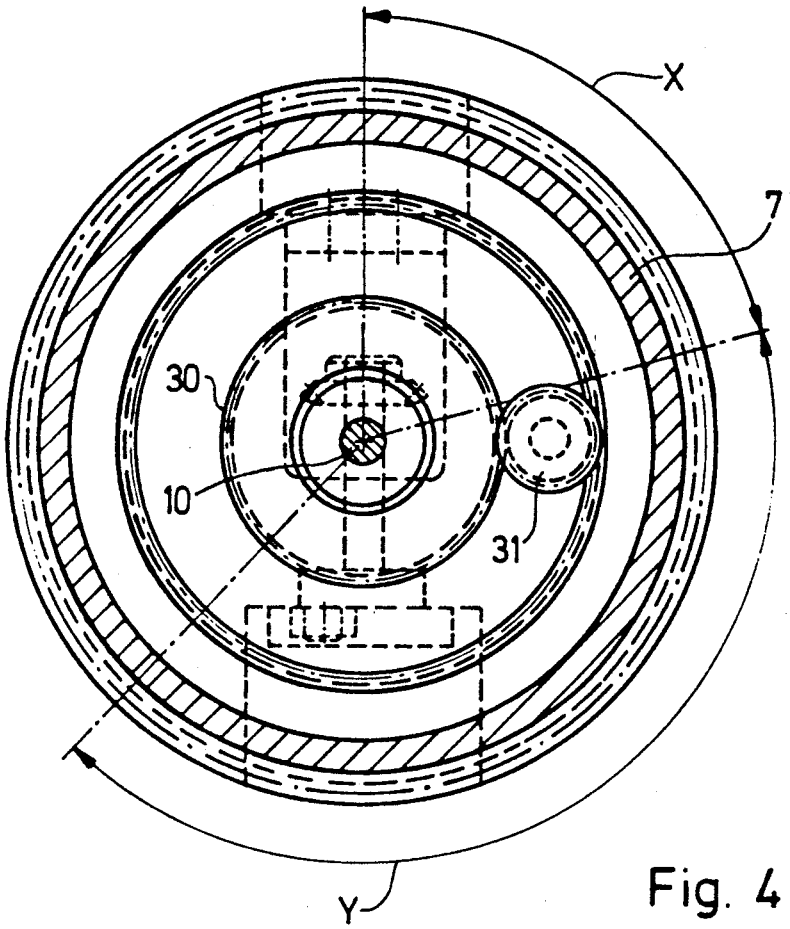
FIG. 4 is a cross-sectional view of FIG. 3 taken along the line IV—IV in the direction of the arrows.
Figure 5:
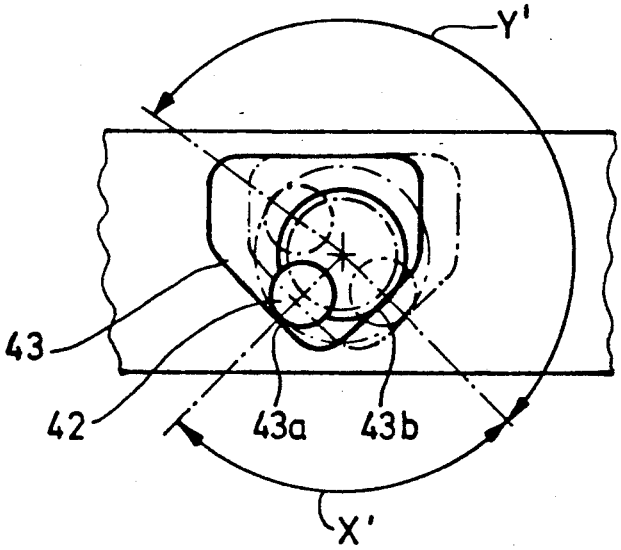
FIG. 5 is a cross-sectional view of FIG. 3 taken along the line V—V in the direction of the arrows.

In the embodiment of the invention illustrated in FIGS. 3 to 9, the construction of and the support for the gripper cylinder 1, as well as the elements for effecting the clamping between the crownlike adjusting gear 7, and the fixed gear 4 correspond to those shown in FIGS. 1 and 2, and like parts in all of the figures are identified by the same reference characters. The elements for changing-over the rotational movement of the control shaft 10 to an axial displacement of the adjusting bridge 24, however, differ in the embodiment of FIGS. 3 to 9 from those in the embodiment of FIGS. 1 and 2. Thus, as shown in FIG. 3, a journal of a bevel gear 39 is rotatably mounted in the bearing support 35. The free end of the control shaft 10 engages in the journal of this bevel gear 39 and, as before, is fixed against rotation relative to the bevel gear 39 yet axially displaceable relative thereto. The bevel gear 39 has teeth which mesh with teeth of another bevel gear 40 fastened on a shaft 41, which is mounted in the gripper cylinder 1, the shaft 41 having an axis extending transversely to the axis 8 of the control shaft 10 and carrying at a free end thereof an eccentric 42. The latter carries an eccentric roller 42*a* mounted eccentrically to the axis of the shaft 41 and engaging in a coulisse or sliding block structure 43 assigned to the adjusting bridge 24. In order to limit the displacement movement on the change-over path and the change-over angle appertaining thereto when adjusting the crownlike adjusting gear 7 with respect to the fixed gear 4, the coulisse or sliding block structure 43 is provided with a special shape, as shown in FIG. 5. In this regard, the coulisse 43 is formed with two straight control surfaces 43*a* and 43*b* enclosing a right angle therebetween, the control surface 43*a* being assigned to first form printing, and the control surface 43*b* to perfector printing. Both control surfaces 43*a* and 43*b* are tangent to an imaginary circle shown in phantom which the outer apex or zenith of the eccentric 42 traverses as the eccentric 42 revolves about the axis of the shaft 41, so that the control surfaces 43*a* and 43*b* define a change-over angle X' from first form printing to perfector printing and the reverse which results due to the transmission ratio of the gears 30 and 31, as well as the inner toothing of the crownlike adjusting gear 7. Outside of these control surfaces 43*a* and 43*b*, i.e., outside of the change-over angle X', the eccentric 42 moves in a free or open space so that, during the adjustment of the crownlike adjusting gear 7 with respect to the fixed gear 4, no displacement of the adjusting bridge 24 occurs in a format adjustment region y (y').

Figure 6:
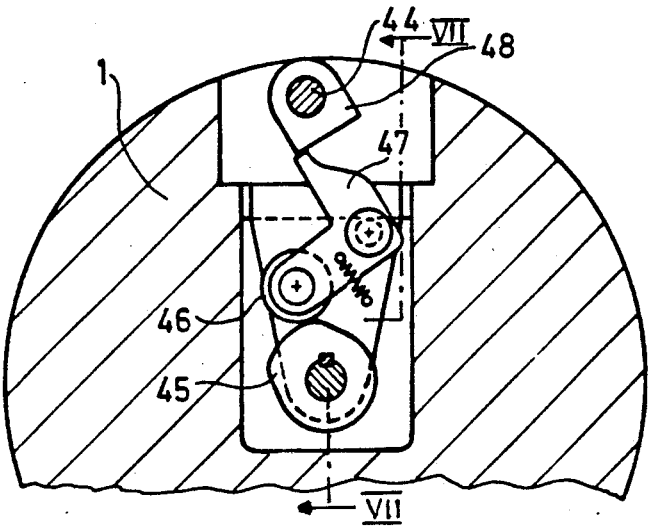
FIG. 6 is a view similar to that of FIG. 2 of a third embodiment of the invention showing members for transmitting rotational movement of a control shaft thereof to a gripper control system, forming part of the invention.
Figure 7:
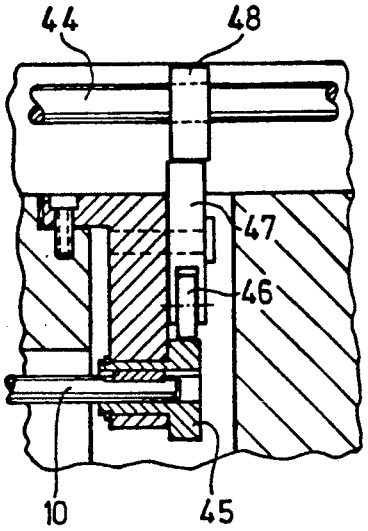
FIG. 7 is a cross-sectional view of FIG. 6 taken along the line VII—VII in the direction of the arrows.
Figure 8:
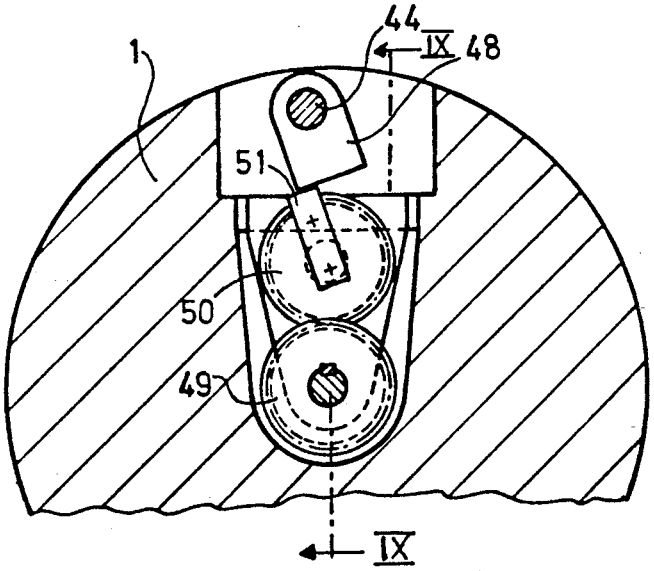
FIG. 8 is a view like that of FIG. 6 of a fourth embodiment of the invention having differently constructed members for transmitting rotational movement of the control shaft thereof to the gripper control system.
Figure 9:
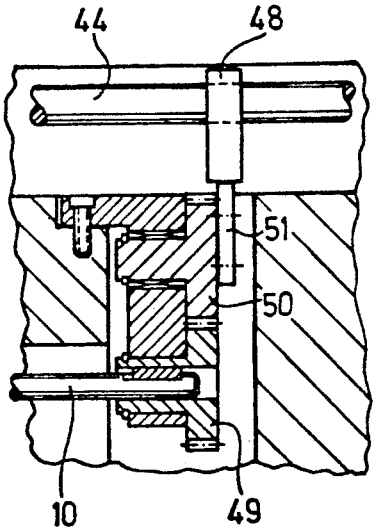
FIG. 9 is a cross-sectional view of FIG. 8 taken along the line IX—IX in the direction of the arrows.

Different embodiments of elements for stopping the rotation of a gripper shaft 44 when adjusting the crownlike adjusting gear 7 with respect to the fixed gear 4 are illustrated in FIGS. 6 to 9. In the arrangement shown in FIGS. 6 and 7, a radial cam 45 is fastened onto the control shaft 10 and blocks a stopping cam 48 on the gripper shaft 44 by means of a roller 46 carried by an angle lever or bellcrank 47. A comparable result to that which is obtained by the foregoing construction of FIGS. 6 and 7, is attainable with the construction of FIGS. 8 and 9 by a pair of gears 49 and 50, of which the gear 49 is fastened onto the control shaft 10, and the other gear 50 has a registering or holding bar 51, which likewise blocks the stopping cam 48 on the gripper shaft 44 in a given angular position.

The foregoing is a description corresponding in substance to German Application P 41 31 273.2, dated Sep. 20, 1991, the International priority of which is being claimed for the instant application, and which is hereby made part of this application.

I claim:

1. Device for changing-over a gripper control on a gripper cylinder of a turning device in a sheet-fed rotary printing machine for first-form and perfector printing, including an adjusting gear and a fixed gear disposed coaxially with one another, the adjusting gear being adjustably movable so as to vary the angular position thereof relative to that of the fixed gear, and a clamping device for clamping the adjusting gear and the fixed gear frictionally together, comprising a control shaft axially displaceable in the gripper cylinder, said control shaft being rotatable and being coupled, via first intermediate converting means, with the adjusting gear so that an adjustable movement of the adjusting gear is converted thereby into a rotary movement of said control shaft, spring means for applying a reaction force to said control shaft in a clamping direction of the adjusting gear, an adjusting bridge carried by the gripper cylinder so as to be displaceable in axial direction thereof, an angle lever disposed in the gripper cylinder so as to be swivelable therein about an axis transverse to the axis of said control shaft for transmitting radial forces to said adjusting bridge, said angle lever having an arm formed with a borehole, said control shaft extending through said borehole and being formed with an abutment shoulder, said shoulder, in a condition wherein said control shaft is loaded with a clamping force, being engageable with an opposing surface on said angle lever for acting thereon, and second intermediate converting means for converting a rotary movement of said control shaft into an axial displacement of said adjusting bridge, said second intermediate converting means including an intermediate member, said control shaft having an end thereof directed towards a middle region of the printing machine and engaging in said intermediate member in a manner that said control shaft is fixed against rotation relative to said intermediate member yet axially displaceable relative thereto.

2. Device according to claim 1, wherein said intermediate member is rotatably mounted in the gripper cylinder.

3. Device according to claim 2, including a bearing disposed in the gripper cylinder, said intermediate member having a journal received in said bearing for supporting said intermediate member, said journal being formed with a bore wherein said end of said control shaft is received.

4. Device according to claim 1, wherein said control shaft is coaxial with the gripper cylinder, and wherein said first intermediate converting means include a toothed indexing wheel mounted on said control shaft outside and coaxially with the gripper cylinder, and an intermediate gear meshing with said indexing wheel and with the adjusting gear.

5. Device according to claim 1, wherein said second intermediate converting means comprise an axial cam supported in a bearing in the gripper cylinder and formed with a pitch corresponding to a control path of said adjusting bridge, and cam following means connected to said adjusting bridge and engaging in said axial cam.

6. Device according to claim 5, wherein said cam following means include a pin secured on said adjusting bridge.

7. Device according to claim 5, wherein said axial cam extends over an angular range corresponding to a conversion angle for displacement of said adjusting bridge.

8. Device according to claim 6, wherein said cam following means also include a roller mounted so as to be freely rotatable on said pin, said roller being received in said axial cam so as to follow said pitch thereof.

9. Device according to claim 1, wherein said second intermediate converting means include an eccentric rotatable about an axis extending transversely to the axis of said control shaft, miter gearing connecting said eccentric to said control shaft for transmitting a drive thereto, and a coulisse formed on said control shaft, said eccentric engaging in said coulisse.

10. Device according to claim 9, wherein said coulisse has a construction wherein said eccentric, during rotation thereof, is axially displaceable within an angular range corresponding to a conversion angle for the adjusting bridge and, beyond said conversion angle, is displaceable in a free space.

11. Device according to claim 10, wherein said coulisse is formed of two straight control surfaces mutual enclosing a substantially right angle and disposed tangentially to an imaginary circle defining an outer locus of an apex of said eccentric during rotation thereof about said axis thereof, said coulisse defined by said control surfaces.

12. Device according to claim 1, including a gripper shaft carried by the gripper cylinder and having a stopping cam secured thereto, a radial cam secured to said control shaft, and a roller lever engaging and controllable by said radial cam for blocking said stopping cam.

13. Device according to claim 1, including a gripper shaft carried by the gripper cylinder and having a .stopping cam secured thereto, a rotatably mounted registering bar disposed adjacent said stopping cam, and a drive pinion secured to said control shaft adjacent said rotatably mounted registering bar for driving said registering bar into a position wherein it blocks said stopping cam.

* * * * *